US010201786B2

(12) United States Patent
Okada et al.

(10) Patent No.: US 10,201,786 B2
(45) Date of Patent: Feb. 12, 2019

(54) FLUID MIXER AND SYSTEM USING THE FLUID MIXER

(71) Applicant: ASAHI ORGANIC CHEMICALS INDUSTRY CO., LTD., Nobeoka-shi, Miyazaki (JP)

(72) Inventors: Takahiro Okada, Nobeoka (JP); Kotaro Matsushita, Nobeoka (JP)

(73) Assignee: ASAHI ORGANIC CHEMICALS INDUSTRY CO., LTD., Nobeoka-Shi, Miyazaki (JP)

( * ) Notice: Subject to any disclaimer, the term of this patent is extended or adjusted under 35 U.S.C. 154(b) by 649 days.

(21) Appl. No.: 14/769,927

(22) PCT Filed: Feb. 20, 2014

(86) PCT No.: PCT/JP2014/054044
§ 371 (c)(1),
(2) Date: Aug. 24, 2015

(87) PCT Pub. No.: WO2014/129548
PCT Pub. Date: Aug. 28, 2014

(65) Prior Publication Data

US 2016/0001240 A1 Jan. 7, 2016

(30) Foreign Application Priority Data

Feb. 25, 2013 (JP) ..... 2013-034479

(51) Int. Cl.
*B01F 5/06* (2006.01)
*B01F 3/08* (2006.01)
*C10L 3/08* (2006.01)

(52) U.S. Cl.
CPC ..... *B01F 5/0603* (2013.01); *B01F 3/0861* (2013.01); *B01F 5/0614* (2013.01);
(Continued)

(58) Field of Classification Search
CPC .... B01F 5/0603; B01F 5/0314; B01F 5/0644; B01F 5/0646; B01F 5/0647; B01F 5/0656; B01F 3/0861
(Continued)

(56) References Cited

U.S. PATENT DOCUMENTS 2,784,948 A * 3/1957 Pahl ..... B01F 5/0451 198/657
3,715,105 A 2/1973 Griffin
(Continued)

FOREIGN PATENT DOCUMENTS

JP 2001-205062 A 7/2001
JP 2011-104481 A 6/2011
(Continued)

OTHER PUBLICATIONS

International Search Report (PCT/ISA/210) dated May 20, 2014, by the Japanese Patent Office as the International Searching Authority for International Application No. PCT/JP2014/054044.

*Primary Examiner* — Marc C Howell
(74) *Attorney, Agent, or Firm* — Buchanan, Ingersoll & Rooney PC

(57) ABSTRACT

The present invention relates to a fluid mixer having a fluid inlet (5), a first passage (1) which connects to the fluid inlet, a helical flow passage (2) which connects to the first flow passage, branched flow passages (4) which are branched from the helical flow passage, a second flow passage (3) to which the branched flow passages individually connect, a connection flow passage (7) which connects the first flow passage and the second flow passage, and a fluid outlet (6) which connects to the second flow passage. The branched flow passages are individually branched from different positions in the direction of flow through the helical flow passages. The branched flow passages which are branched from the helical flow passage individually connect to the
(Continued)

second flow passage at different positions in the direction of flow through the second flow passage.

12 Claims, 11 Drawing Sheets

(52) U.S. Cl.
CPC ..... *B01F 5/0644* (2013.01); *B01F 5/0646* (2013.01); *B01F 5/0647* (2013.01); *B01F 5/0656* (2013.01); *C10L 3/08* (2013.01)

(58) Field of Classification Search
USPC ..... 366/177.1
See application file for complete search history.

(56) References Cited

U.S. PATENT DOCUMENTS

| | | | | |
|---|---|---|---|---|
| 2002/0021620 | A1 | 2/2002 | Choikhet et al. | |
| 2011/0128814 | A1* | 6/2011 | Hanada ..... | B01F 5/0614 366/339 |
| 2012/0307589 | A1 | 12/2012 | Hanada et al. | |

FOREIGN PATENT DOCUMENTS

| | | | |
|---|---|---|---|
| JP | 2011-161323 | S | 8/2011 |
| WO | WO 2010/016448 | A1 | 2/2010 |

* cited by examiner

FLUID MIXER AND SYSTEM USING THE FLUID MIXER

FIELD OF THE INVENTION

The present invention relates to a fluid mixer used in fluid feed tubing systems, for example, in chemical plants and various industries such as semiconductor production, food, medical, and biotechnology industries, and in particular, to a fluid mixer and a system using the fluid mixer that can mix and agitate fluid to achieve an even and uniform concentration profile or temperature profile in the direction of flow of the fluid.

DESCRIPTION OF THE RELATED ART

Conventionally, a static mixer element 101 that includes twisted blades as illustrated in FIG. 13 has been generally used as a device that is disposed in a tubing system to uniformly mix fluid substances that flow through the tubing (see, for example, Patent Literature 1). Usually, the static mixer element 101 includes a plurality of basic units that are formed by twisting a rectangular plate 180 degrees around its longitudinal axis and that are integrally connected to each other in serial so that the units alternate in the direction of twisting. A static mixer is formed by disposing the static mixer element 101 in a tube 102, connecting male connectors 103 to the both ends of the tube 102, forming flares 105, and fastening the connectors with flare nuts 104. The static mixer element 101 is designed so that the element has an outer diameter that is substantially equal to the inner diameter of the tube 102, to effectively agitate the fluid substances.

RELATED ART DOCUMENT

Patent Document

Patent Literature 1: Japanese Patent Publication No. 2001-205062

SUMMARY OF THE INVENTION

Problems to be Solved by the Invention

Although a method for mixing fluid using the conventional static mixer is configured to agitate the fluid along the direction of flow of the fluid, and thus the method can provide an even and uniform concentration profile along the diameter direction of the tube Dd as illustrated in FIG. 14, the method cannot provide an even and uniform concentration profile along the axis direction (the flow direction) of the tube Fd as illustrated in FIG. 15. Thus, for example, when water and a chemical solution are combined upstream of the static mixer and fed, if the combined fluid has a portion of a higher concentration of the chemical solution, the combined fluid, which has a portion of a higher concentration of the chemical solution, flows through the static mixer. At the time, the mixer mixes the water and the chemical solution uniformly along the diameter direction Dd of the tube, while along the axis direction (the direction of flow) Fd, the portion of a higher concentration of the chemical solution may not be completely diluted, and the fluid that still has the portion of a higher concentration may be fed downstream (see FIG. 15). Thus, the mixer has the problem that when the mixer is connected to an apparatus for cleaning semiconductor, especially, an apparatus for applying an agent directly to the surface of semiconductor wafers to carry out various processes, the agent having a varying concentration is applied to the semiconductor wafers, which results in defective products.

Examples of a method for avoiding the formation of a concentration profile that is uneven along the axis direction (the flow direction) include a method for temporarily storing fluid in a tank disposed between the ends of a channel to equalize the concentration in the tank and then feeding the fluid (not shown). However, the method has the problem that the system is bulky because the tank occupies a large space, the number of components increases since a pump, a tube, and the like are required for drawing the fluid from the tank, and it is expensive to build a tubing line. Additionally, in the method, the fluid is stagnant in the tank. The stagnant fluid allows bacteria to grow, and the bacteria grown in the tank flow into the tubing line. In the case of a semiconductor production line, the bacteria adhere to semiconductor wafers, which results in defective products.

The present invention has been made in view of the foregoing problems of the conventional art and has an object to provide a compact fluid mixer that can mix and agitate fluid to provide an even and uniform concentration profile or temperature profile in the direction of flow of the fluid.

Means of Solving the Problems

According to one aspect, the present invention provides a fluid mixer including a fluid inlet, a first channel that is connected to the fluid inlet, a helical channel that is connected to the first channel, a plurality of branch channels that diverge from the helical channel, a second channel that is connected to the plurality of branch channels, a communicating channel that allows the first channel to communicate with the second channel, and a fluid outlet that is connected to the second channel, wherein the plurality of branch channels each diverge from the helical channel at different locations in the flow direction, and the plurality of branch channels that diverge from the helical channel are each connected to the second channel at different locations in the flow direction.

In other words, the invention according to the first aspect can provide an even and uniform concentration profile in the direction of flow of fluid and can provide fluid having a stable concentration, even when chemical solution is combined upstream of the fluid mixer, so that the combined fluid has a portion of a higher concentration of a chemical solution and a portion of a lower concentration of the chemical solution. Thus, the mixer can prevent the production of defective products due to variations in the concentration of a chemical solution in the various fields.

According to a second aspect, the present invention provides that the mixer includes a body that includes, inside of the body, the first channel, the second channel, the communicating channel, and the branch channels, and that includes, on the outer peripheral surface of the body, a helical groove that allows the first channel to communicate with the branch channels, and a housing that has an inner peripheral surface that forms the helical channel with the helical groove when the housing fits over the outer peripheral surface of the body, wherein the first channel, the second channel, and the communicating channel are coaxially disposed with each other.

In other words, since the first channel, the second channel and the communicating channel are coaxially disposed in the invention according to the second aspect, a pressure loss in the fluid can be decreased, and the fluid can smoothly flow from the first channel through the communicating channel to the second channel. Since the fluid can smoothly flow from the first channel through the communicating channel to the second channel, the fluid that flows through the communicating channel to the second channel can exit from the fluid outlet earlier than the fluid that flows from the helical channel through the branch channels to the second channel. Such configuration can increase the difference between the length of time that the fluid flowing through the communicating channel to the second channel exits from the fluid mixer and the length of time that the fluid flowing from the helical channel through the branch channels to the second channel exits from the fluid mixer, thereby more effectively achieving an even and uniform concentration profile along the flow direction. Further the mixer can be compact with a fewer number of components.

According to a third aspect, the present invention provides that the mixer includes a body that includes, inside of the body, the second channel, the communicating channel, and the branch channels and that includes, on the outer peripheral surface of the body, a helical groove communicating with the branch channels and extending from an end surface on the side of the communicating channel, and a housing that includes the first channel at one end of the housing and an inner peripheral surface forming the helical channel with the helical groove when the housing fits over the outer peripheral surface of the body, wherein the first channel, the second channel, and the communicating channel are coaxially disposed with each other.

In other words, the invention according to the third aspect can direct fluid to the helical channel without significantly changing the direction of flow of the fluid that flows into the first channel, and thus a pressure loss can be decreased when the fluid enters into the helical channel, thereby smoothly feeding the fluid from the first channel to the helical channel. This can prevent the fluid in the first channel from flowing, in an imbalanced manner, into the communicating channel, which is disposed coaxially with the first channel, thereby dividing the fluid in the first channel into the communicating channel and the branch channels in a balanced manner.

According to a fourth aspect, the present invention provides the fluid mixer according to the second or third aspects, wherein a plurality of the helical grooves are disposed on the outer peripheral surface of the body, wherein the helical grooves are circumferentially offset with respect to each other, and wherein at least one of the plurality of helical grooves has a length that is shorter than the length of the other helical groove(s), and a terminal end of the shorter helical groove joins the other helical groove(s).

In other words, the invention according to the fourth aspect includes a larger number of the helical grooves, i.e., a larger number of the side walls of the helical grooves, and thus the contact area between the outer peripheral surface of the body and the inner peripheral surface of the housing can be increased, thereby preventing damage to the side walls of the helical grooves and allowing the body to be stably fit into the housing. Such configuration is beneficial especially when the housing is fit over the body by abutting an end of the body against the housing. Due to the increased number of the helical channels, each of the helical channels can have, for example, a separate cross-sectional area, a separate cross-sectional shape, and a separate number of the branch channels to be connected to the helical channel, and thus design flexibility of the fluid mixer is improved. Since the plurality of helical channels join together, fluid substances in the helical channels can collide with each other, and thus mixing of the fluid substances is promoted.

According to a fifth aspect, the present invention provides the fluid mixer according to any one of the second to fourth aspects, wherein the helical groove is progressively wider from the fluid inlet side toward the fluid outlet side.

In other words, the invention according to the fifth aspect can prevent the flow channel downstream of the helical channel from having an excessively small cross-sectional area. As the fluid in the helical channel flows downstream, the fluid is decreasing in flow volume. Thus due to the prevention of the flow channel downstream of the helical channel from having an excessively small cross-sectional area, as the fluid in the helical channel flows downstream, the fluid can be decreasing in flow rate. Such configuration can control the fluid in the helical channel to take more time to reach the respective branch channels, as the fluid flows downstream. Therefore, the configuration can increase the difference in the lengths of time that the respective fluid streams flowing through the respective branch channels to the second channel take to exit the fluid mixer, and thus can more effectively achieve an even and uniform concentration profile along the flow direction.

According to the sixth aspect, the present invention provides the fluid mixer according to any one of the second to fifth aspects, wherein the second channel has a cross-sectional area that progressively increases from the fluid inlet side toward the fluid outlet side, and wherein the cross-sectional area of the second channel at respective connections between the plurality of the branch channels and the second channel is equal or smaller than the sum of the cross-sectional areas of the branch channels at the connections in which fluid has flowed into the second channel before reaching the respective connections and the cross-sectional area of the communicating channel.

In other words, the invention according to the sixth aspect can increase the flow rate of the fluid streams flowing through the communicating channel or the respective branch channels to the second channel, and thus can rapidly discharge the fluid streams from the fluid mixer, thereby increasing the difference between the length of time that the fluid stream flowing through the communicating channel to the second channel takes to exit the fluid mixer and the length of time that the respective fluid streams flowing through the respective branch channels to the second channel take to exit the fluid mixer, and thus more effectively achieving an even and uniform concentration profile along the flow direction.

According to the seventh aspect, the present invention provides a system using a fluid mixer, the system includes the fluid mixer according to any one of the first to sixth aspects, and flow channel forming means for forming flow channels that combine and direct a plurality of different fluids.

In other words, the invention according to the seventh aspect can provide a system that can mix a wide variety of different fluid substances, because the mixer includes the fluid mixer as described above and the flow channel forming means.

Effects of the Invention

The invention according to the first to sixth aspects can provide a fluid mixer that can provide an even and uniform concentration profile along the direction of flow of fluid, can provide fluid having a stable concentration, and can prevent the production of defective products due to variations in the concentration of a chemical solution, even when the fluid substances are combined upstream of the fluid mixer, so that the combined fluid has a portion of a higher or lower concentration of the chemical solutions.

The invention according to the seventh aspect can further provide a system that can mix a wide variety of different fluid substances.

DESCRIPTION OF THE EMBODIMENTS

Figure 1:
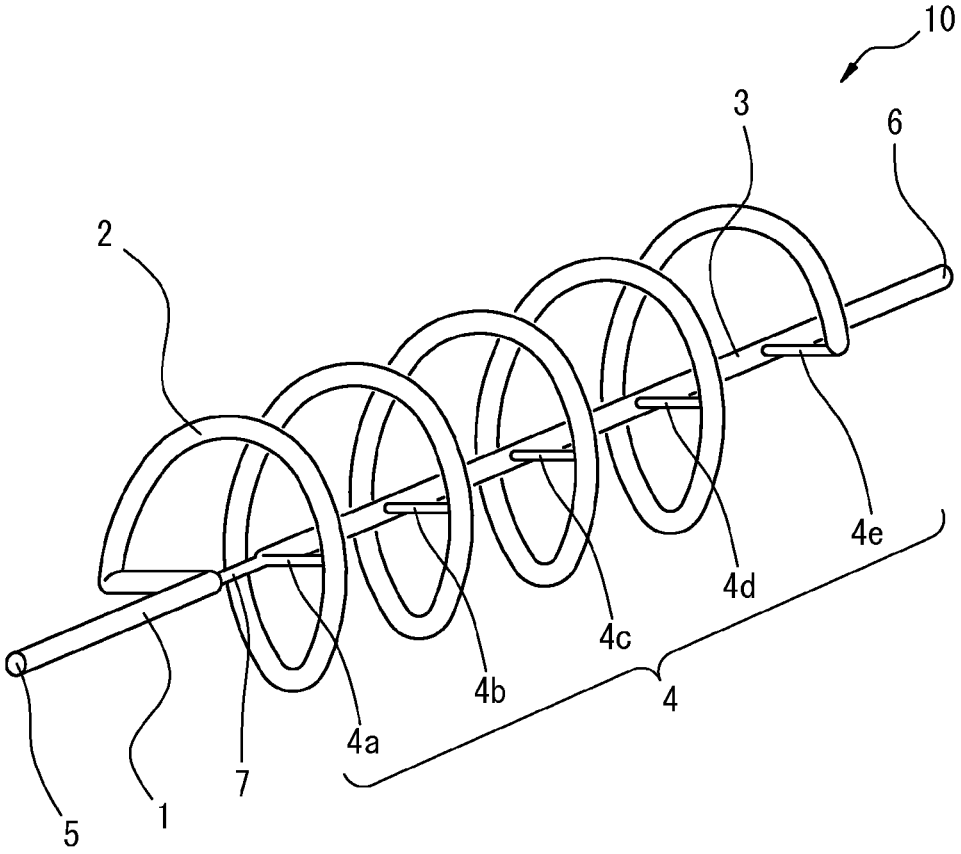
FIG. 1 is a perspective view illustrating the general configuration of a fluid mixer according to a first embodiment of the present invention.

Embodiments of the present invention will be described with reference to the examples illustrated in the drawings, although it should be appreciated that the present invention is not limited to the embodiments.

First Embodiment

A fluid mixer according to a first embodiment of the present invention will be described with reference to FIGS. 1-4. FIG. 1 is a perspective view illustrating the general configuration of a fluid mixer according to the first embodiment. The fluid mixer includes a mixing conduit 10 for mixing different fluid substances. The mixing conduit 10 is made of, for example, PFA (tetrafluoroethylene-perfluoroalkylvinylether copolymer resin) tubing. The mixing conduit 10 may be made of other materials such as metal tubing.

The mixing conduit 10 includes a fluid inlet 5 for receiving a fluid substance, a first channel 1 that has the fluid inlet 5 at one end of the channel, a fluid outlet 6 for discharging the fluid substance, a second channel 3 that has the fluid outlet 6 at the opposite end from the fluid inlet 5, a communicating channel 7 that allows the first channel 1 to communicate with the second channel 3 at the shortest distance and that has a smaller inner diameter compared with the first and second channels, a helical channel 2 that is disposed helically and concentrically around the first channel 1, the second channel 3, and the communicating channel 7, and a plurality of branch channels 4*a*-4*e* that allow the second channel 3 to communicate with the helical channel 2 at a plurality of locations.

The first channel 1, the second channel 3, and the communicating channel 7 are coaxially disposed to form a linear tube. The first channel 1 is connected to one end of the helical channel 2. The five branch channels 4*a*-4*e*, which are disposed between the ends of the helical channel 2, are each connected to the second channel 3 and have an approximately linear shape, i.e., a straight or substantially straight shape. The branch channels 4*a*-4*e* each diverge and extend from the second channel 3 approximately perpendicular, i.e., perpendicular or substantially perpendicular to the flow direction of the second channel 3. The branch channel 4*e*, which is closest to the fluid outlet 6, is connected to the other end of the helical channel 2. In other words, the plurality of branch channels 4*a*-4*e* each diverge from the helical channel 2 at different locations in the flow direction of the helical channel 2 and are each connected to the second channel 3 at different locations in the flow direction of the second channel 3.

Next, the operation of the fluid mixer according to the first embodiment of the present invention will be described.

Water and a chemical solution are combined upstream of the fluid mixer so that the combined fluid has a portion of a higher concentration of the chemical solution. Then, the fluid, which has a portion of a higher concentration of the chemical solution, enters the first channel 1 through the fluid inlet 5 and then flows downstream. When the fluid, which has a portion of a higher concentration of the chemical solution, flows through the connection between the first channel 1 and the communicating channel 7, a part of the fluid flows through the communicating channel 7 to the second channel 3 and the fluid outlet 6. When the communicating channel 7 is formed so that the channel 7 has a smaller inner diameter than the inner diameter of the first channel 1, the fluid from the first channel 1 can be divided into the communicating channel 7 and the helical channel 2 in a balanced manner.

The other part of the fluid enters the helical channel 2. When the fluid in the helical channel 2 reaches the connection between the helical channel 2 and the branch channel 4*a*, a part of the fluid is bypassed into the branch channel 4*a*. The fluid in the branch channel 4*a* flows through the second channel 3 to the fluid outlet 6. The other part flows downstream of the helical channel 2. Then when the other part, which has a portion of a higher concentration of the chemical solution, reaches the connection between the helical channel 2 and the branch channel 4*b*, a part of the fluid is bypassed into the branch channel 4*b*. The fluid in the branch channel 4*b* flows through the second channel 3 to the fluid outlet 6. The other part flows downstream of the helical channel 2. Then when the other part, which has a portion of a higher concentration of the chemical solution, reaches the connection between the helical channel 2 and the branch channel 4*c*, a part of the fluid is bypassed into the branch channel 4*c*, as with the fluid at the connection to the branch channel 4*b*. The fluid in the branch channel 4*c* flows through the second channel 3 to the fluid outlet 6. As with the fluid at the connections to the branch channels 4*a*, 4*b*, and 4*c*, the fluid downstream of the branch channel 4*c*, the fluid having a portion of a higher concentration of the chemical solution, is bypassed into the branch channels 4*d* and 4*e* and then flows through the second channel 3 to the fluid outlet 6.

The fluid that enters the communicating channel 7, the fluid having a portion of a higher concentration of the chemical solution, takes the shortest route from the fluid inlet 5 to the fluid outlet 6 and thus exits the fluid outlet 6 earlier than the fluid that flows through the branch channels 4, the fluid having a portion of a higher concentration of the chemical solution. Among the streams that flow through the branch channels 4, the stream that flows through the branch channel 4*a*, the stream having a portion of a higher concentration of the chemical solution, takes the shortest route from the fluid inlet 5 to the fluid outlet 6, and thus exits the fluid outlet 6 earlier than the other streams that flow through the other branch channels 4. At staggered times, the respective streams, which have a portion of a higher concentration of the chemical solution, in the branch channel 4*b*, the branch channel 4*c*, the branch channel 4*d*, and the branch channel 4*e* in this order exit the fluid outlet 6. In other words, the fluid mixer allows the fluid having a portion of a higher concentration of the chemical solution to be divided into 6 streams and to be combined, at staggered times, with a portion having a lower concentration of the chemical solution, thereby achieving an even and uniform concentration profile along the direction of flow of the fluid.

In the first embodiment, the branch channels 4*a*-4*e* are equally spaced along the axis of the second channel 3, as illustrated in FIG. 1, although the branch channels may be disposed at any locations to adjust the difference in the lengths of time that the respective streams in the branch channels 4*a*-4*e* take to flow into the second channel 3. In the first embodiment, the branch channels 4*a*-4*e* are configured to have a same inner diameter, although the branch channels 4 may have any inner diameter to adjust the amount of the fluid flowing through the branch channels 4*a*-4*e*. Similarly, the fluid mixer may have any number of the branch channels 4, and the branch channels 4 may, for example, have any length and may form any angle with the second channel 3.

Figure 2:
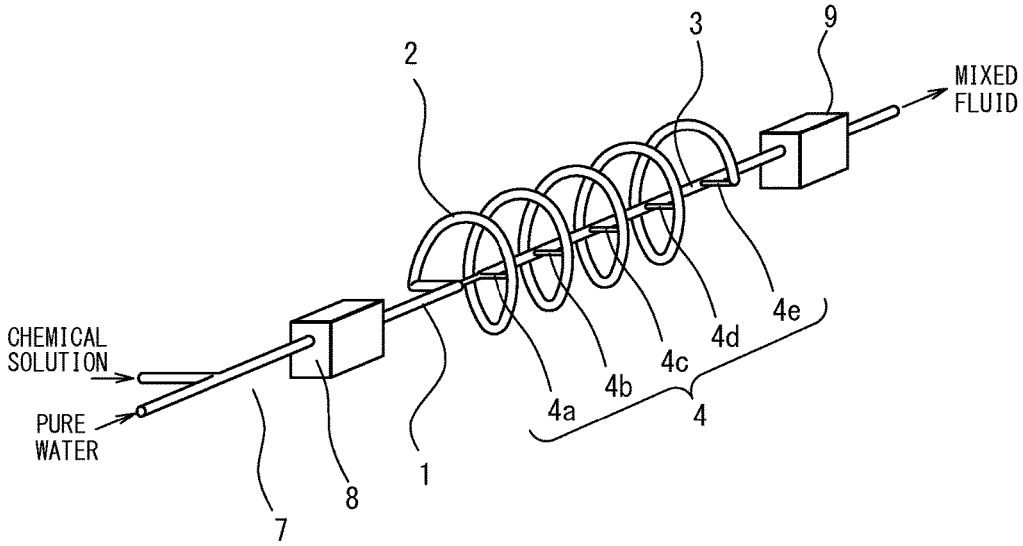
FIG. 2 is a schematic view of a system that uses the fluid mixer of FIG. 1 to measure the concentration of fluid.

How the fluid mixer divides the fluid that has a portion of a higher concentration of the chemical solution to achieve an even and uniform concentration profile along the direction of flow of the fluid will be described. As illustrated in FIG. 2, the fluid mixer of FIG. 1 is disposed downstream of a connection between a line for pure water and a line for a chemical solution, and concentration meters 8 and 9 are respectively disposed upstream and downstream of the fluid mixer of FIG. 1 to produce a system for combining water and the chemical solution upstream of the mixer and feeding the combined fluid. After the water and the chemical solution are combined so that the combined fluid has an initial concentration of the chemical solution, the water and the chemical solution are combined so that the combined fluid has a higher concentration of the chemical solution (by increasing the ratio of the chemical solution to the water). Then again, the water and the chemical are combined so that the combined fluid has the initial concentration of the chemical solution. In this way, the resultant fluid flow has an uneven concentration profile of the chemical solution. The upstream concentration and the downstream concentration are illustrated in FIG. 3 and FIG. 4, respectively.

Figure 3:
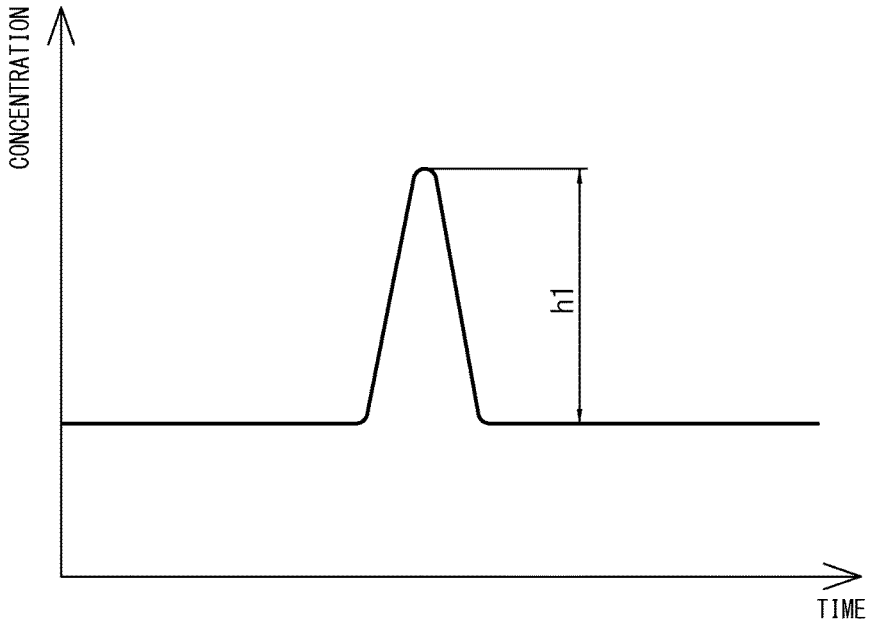
FIG. 3 is a graph illustrating the concentration of fluid in an upstream region of the fluid mixer of FIG. 2.
Figure 4:
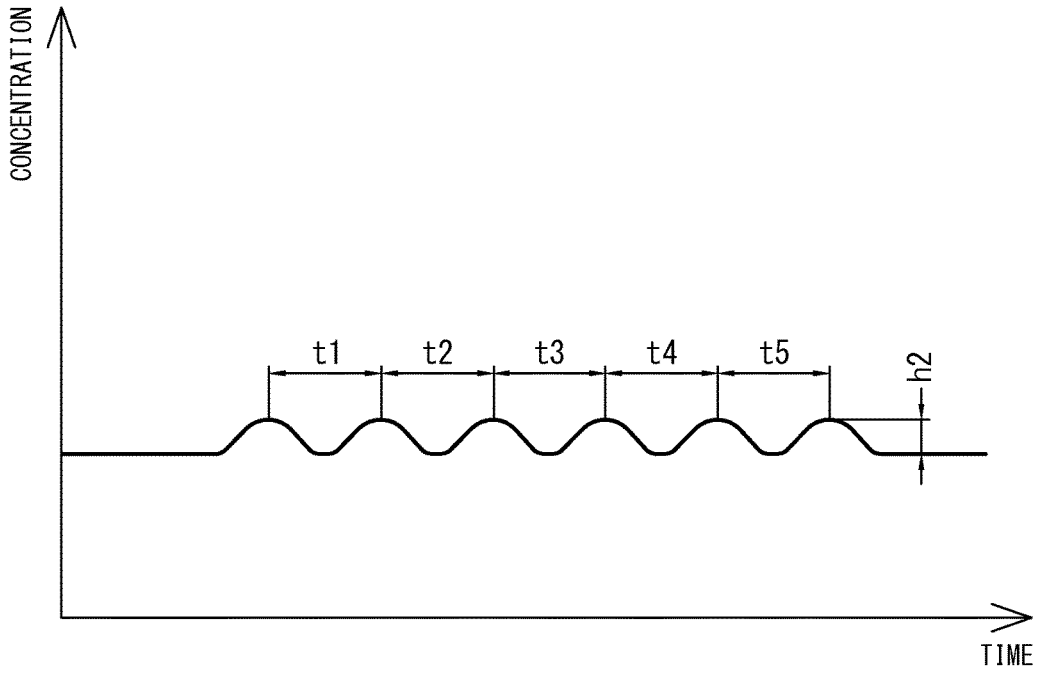
FIG. 4 is a graph illustrating the concentration of fluid in a downstream region of the fluid mixer of FIG. 2.

FIG. 3 illustrates a profile obtained using the concentration meter 8 that is disposed upstream of the fluid mixer. The time is taken along the abscissa, and the concentration is taken along the ordinate. When the fluid stream exhibits a higher concentration for a limited period, the profile has a peak (h1) as illustrated in FIG. 3. FIG. 4 illustrates a profile obtained using the concentration meter 9 that is disposed downstream of the fluid mixer. Referring to FIG. 4, the profile has 6 concentration peaks, and the peaks (h2) are lower by a factor of about 6, compared with the peak (h1). The time interval t1 between the concentration peaks corresponds to the length of time that the fluid in the first channel 1 takes to flow through the communicating channel 7 to the branch channel 4*a* in the second channel 3. The time interval t2 between the concentration peaks corresponds to the difference between the length of time that the fluid in the helical channel 2 takes to flow from the connection between the helical channel 2 and the branch channel 4*a* to the branch channel 4*b* and the length of time that the fluid in the second channel 3 takes to flow from the connection between the second channel 3 and the branch channel 4*a* to the branch channel 4*b*. As with t2, t3 corresponds to the difference between the length of time that the fluid in the helical channel 2 takes to flow from the connection between the helical channel 2 and the branch channel 4*b* to the branch channel 4*c* and the length of time that the fluid in the second channel 3 takes to flow from the connection between the second channel 3 and the branch channel 4*b* to the branch channel 4*c*. t4 corresponds to the difference between the length of time that the fluid in the helical channel 2 takes to flow from the connection between the helical channel 2 and the branch channel 4*c* to the branch channel 4*d* and the length of time that the fluid in the second channel 3 takes to flow from the connection between the second channel 3 and the branch channel 4*c* to the branch channel 4*d*. t5 corresponds to the difference between the length of time that the fluid in the helical channel 2 takes to flow from the connection between the helical channel 2 and the branch channel 4*d* to the branch channel 4*e* and the length of time that the fluid in the second channel 3 takes to flow from the connection between the second channel 3 and the branch channel 4*d* to the branch channel 4*e*.

The time intervals t1-t5 between the peaks (h2) can be varied by changing the length of time that the fluid takes to reach the communicating channel 7 and the lengths of time that the fluid in the helical channel 2 takes to reach the respective branch channels 4*a*-4*e*. When the number of the branch channels 4 is increased, the peak (h2) can be further lowered to the height that is similar to the height of the upstream peak (h1) divided by the sum of the number of the communicating channel 7 and the number of the branch channels 4. When the time intervals t1-t5 were short, a plurality of the peaks (h2) would be merged into a higher peak. Thus, the time intervals t1-t5 should be long enough to lower the peaks (h2). To increase the time intervals t1-t5 to avoid the overlap of the peaks (h2), it is required to increase the difference in the lengths of time that the respective fluid streams in the communicating channel 7 and the branch channels 4*a*-4*e* take to exit the fluid mixer. Examples of a method for increasing such difference include a method of increasing the distance between the communicating channel 7 and the branch channel 4*a* and the distance between the branch channels 4*a*-4*e* and a method of modifying, for example, the shape and the cross-sectional area of the first channel 1, the helical channel 2, the second channel 3, and the branch channels 4 to change the flow rate of the fluid flowing through these channels (especially, a method of decreasing the flow rate of the fluid flowing through the helical channel 2 and increasing the flow rate of the fluid flowing through the second channel 3). When the fluid mixer was not disposed, the concentration profile would still have the peak (h1), although the concentration peak might be slightly lower depending on the flow of the fluid, compared with the peak illustrated in FIG. 3.

In the first embodiment, the fluid inlet 5 is used as the inlet, and the fluid outlet 6 is used as the outlet to feed the fluid from the fluid inlet 5 to the fluid outlet 6, although similar effects can be achieved when the fluid is allowed to flow in the reverse direction. In this case, the fluid outlet 6 is used as the fluid inlet, and the fluid inlet 5 is used as the fluid outlet.

The first embodiment is described for dealing with the variations in the concentration profile, although similar effects can be achieved when the fluid mixer is used to create a uniform temperature profile in the flow direction when hot water and cold water are combined. The fluid mixer may be used in, for example, a water heater to create a uniform temperature profile. The fluid mixer can equalize the temperature of fluid in a flow path in the flow direction, the fluid having a high-temperature portion, to stabilize the temperature, thereby preventing scalds due to hot water.

Second Embodiment

Figure 5:
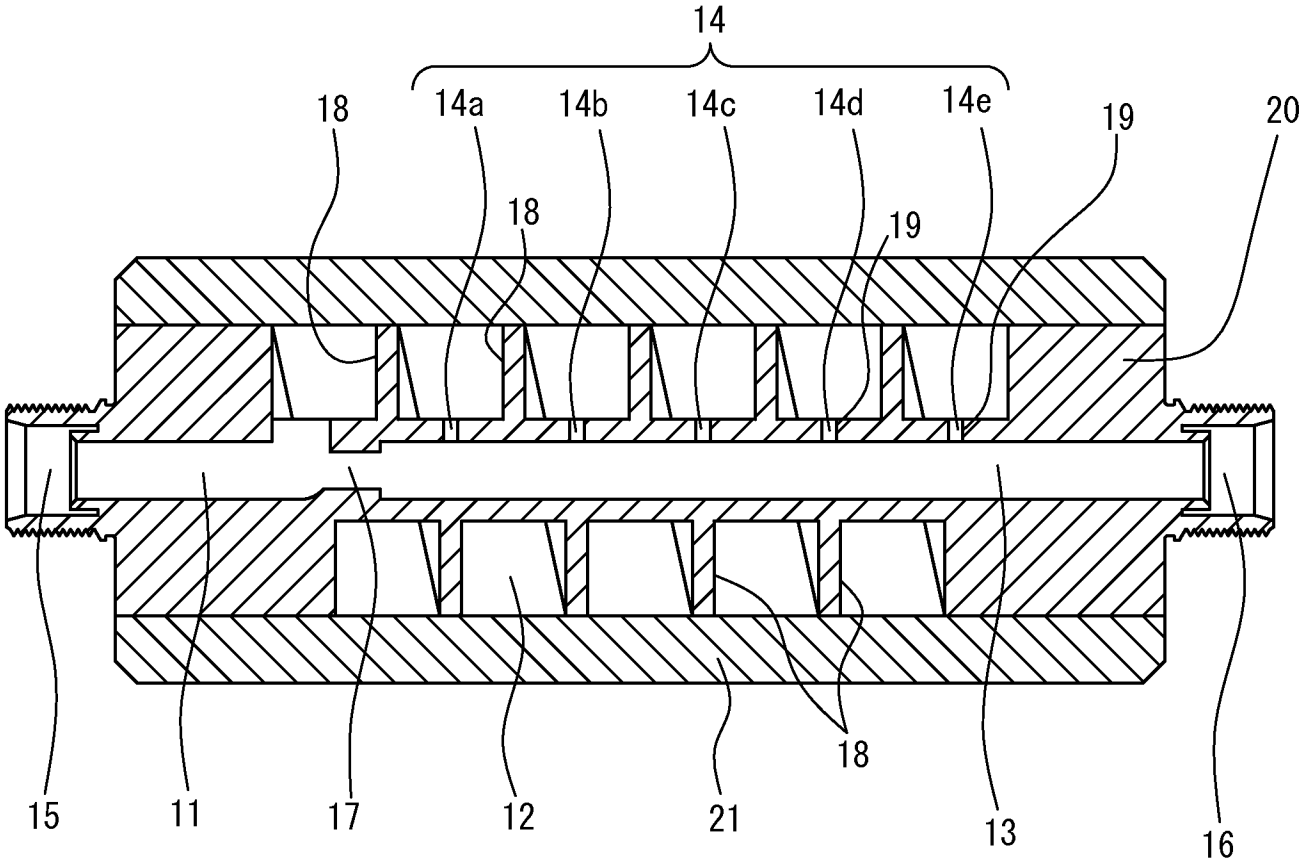
FIG. 5 is a vertical cross-sectional view illustrating the general configuration of a fluid mixer according to a second embodiment of the present invention.

Next, a fluid mixer according to a second embodiment of the present invention will be described with reference to FIG. 5. FIG. 5 is a vertical cross-sectional view illustrating the general configuration of the fluid mixer according to the second embodiment. In the second embodiment, the fluid mixer includes an approximately cylindrical, i.e., cylindrical or substantially cylindrical body 20 and a cylindrical casing 21 that fits over an outer peripheral surface of the body 20, and a mixing conduit is formed by the body 20 and the casing 21.

The body 20 is, for example, made of PTFE (polytetrafluoroethylene). In the second embodiment, the body 20 has a cylindrical form. And a fluid inlet 15 is provided at one end of the body 20, and a first channel 11 is connected to the fluid inlet 15. At the other end, a fluid outlet 16 is provided, and a second channel 13 is connected to the fluid outlet 16. The first channel 11 and the second channel 13 are in communication via a communicating channel 17, at the shortest distance. The first channel 11, the second channel 13, and the communicating channel 17 are disposed linearly along the central axis of the body 20. A helical groove 18 is formed on the outer peripheral surface of the body 20. The first channel 11 is connected to one end of the helical groove 18. And communication holes 19 form a plurality of branch channels 14 that allow the inner peripheral surface of the second channel 13 to communicate with the bottom surface of the helical groove 18. One of the communication holes 19 that is closest to the fluid outlet 16 is in communication with the other end of the helical groove 18.

In the second embodiment, the cylindrical casing 21 is made of PFA tubing and serves as a housing for the fluid mixer. The cylindrical casing 21 is approximately cylindrically shaped and has an inner diameter that is approximately the same as the outer diameter of the body 20. The cylindrical casing 21, which is a tube, is shrink-fitted onto the body 20 to seal against the outer peripheral surface of the body 20. Once the cylindrical casing 21 is fitted onto the body 20, the helical groove 18 of the body 20 and the inner peripheral surface of the cylindrical casing 21 together form a helical channel 12.

The cylindrical casing 21 as the housing may be formed of a hard material instead of a soft material such as tubing. The housing may have any other tubular shape such as a cuboid shape instead of a cylindrical shape. Instead of shrink-fitting, any other techniques such as welding and gluing may be used to fit the cylindrical casing 21 onto the body 20 as long as the cylindrical casing 21 can be sealed against the body.

Next, the operation of the fluid mixer according to the second embodiment of the present invention will be described.

Water and a chemical solution are combined upstream of the fluid mixer so that the resulted fluid has a portion of a higher concentration of the chemical solution. Then, the fluid, which has a portion of a higher concentration of the chemical solution, enters the first channel 11 through the fluid inlet 15 and then flows downstream. When the fluid, which has a portion of a higher concentration of the chemical solution, flows through the connection point between the first channel 11 and the communicating channel 17, a part of the fluid flows through the communicating channel 17 to the second channel 13. At the time, a pressure loss can be decreased, because the communicating channel 17 is disposed coaxially with the first channel 11 and the second channel 13. Thus, the fluid can flow smoothly from the first channel 11 through the communicating channel 17 into the second channel 13. The fluid that enters the communicating channel 17 flows through the second channel 13 and exits the fluid mixer through the fluid outlet earlier than the fluid that enters the helical channel 12. Such configuration can create a difference between the length of time that the fluid takes to flow from the communicating channel 17 through the second channel 13 and exit the fluid mixer and the length of time that the fluid takes to flow from the helical channel 12 through the branch channels 14 into the second channel 13 and exit the fluid mixer, thereby effectively achieving an even and uniform concentration profile in the flow direction. As the communicating channel 17 has an inner diameter that is smaller than the inner diameter of the first channel 11, the fluid can be divided into the communicating channel 17 and the helical channel 12 in a balanced manner.

One part of the fluid in the first channel 11 enters the communicating channel 17, while the other part of the fluid enters the helical channel 12. The fluid in the helical channel 12, the fluid having a portion of a higher concentration of the chemical solution, is divided into the branch channels 14, through which the fluid flows into the second channel 13. The respective fluid streams, which have a portion of a higher concentration of the chemical solution, flow through the communicating channel 17 or the respective branch channels 14 into the second channel 13 at staggered times, where the respective streams are combined with a stream that has a lower concentration of the chemical solution, thereby achieving an even and uniform concentration profile in the direction of flow of the fluid. The mechanism for achieving an even and uniform concentration profile in the direction of flow of the fluid in the second embodiment is similar to that of the first embodiment and thus is not described here.

The fluid mixer according to the second embodiment can be processed relatively easily for its complex flow channels and can be produced easily due to fewer components. The compact structure of the flow channel system can provide a reduced-size fluid mixer, which can be installed without a space for tubing. The fluid mixer can be connected to plumbing lines only by connecting the fluid inlet 15 and the fluid outlet 16 via, for example, respective joints, which simplifies the tubing work and shortens the time required for the tubing work.

Third Embodiment

A fluid mixer according to a third embodiment of the present invention will be described with reference to FIGS.

Figure 6:
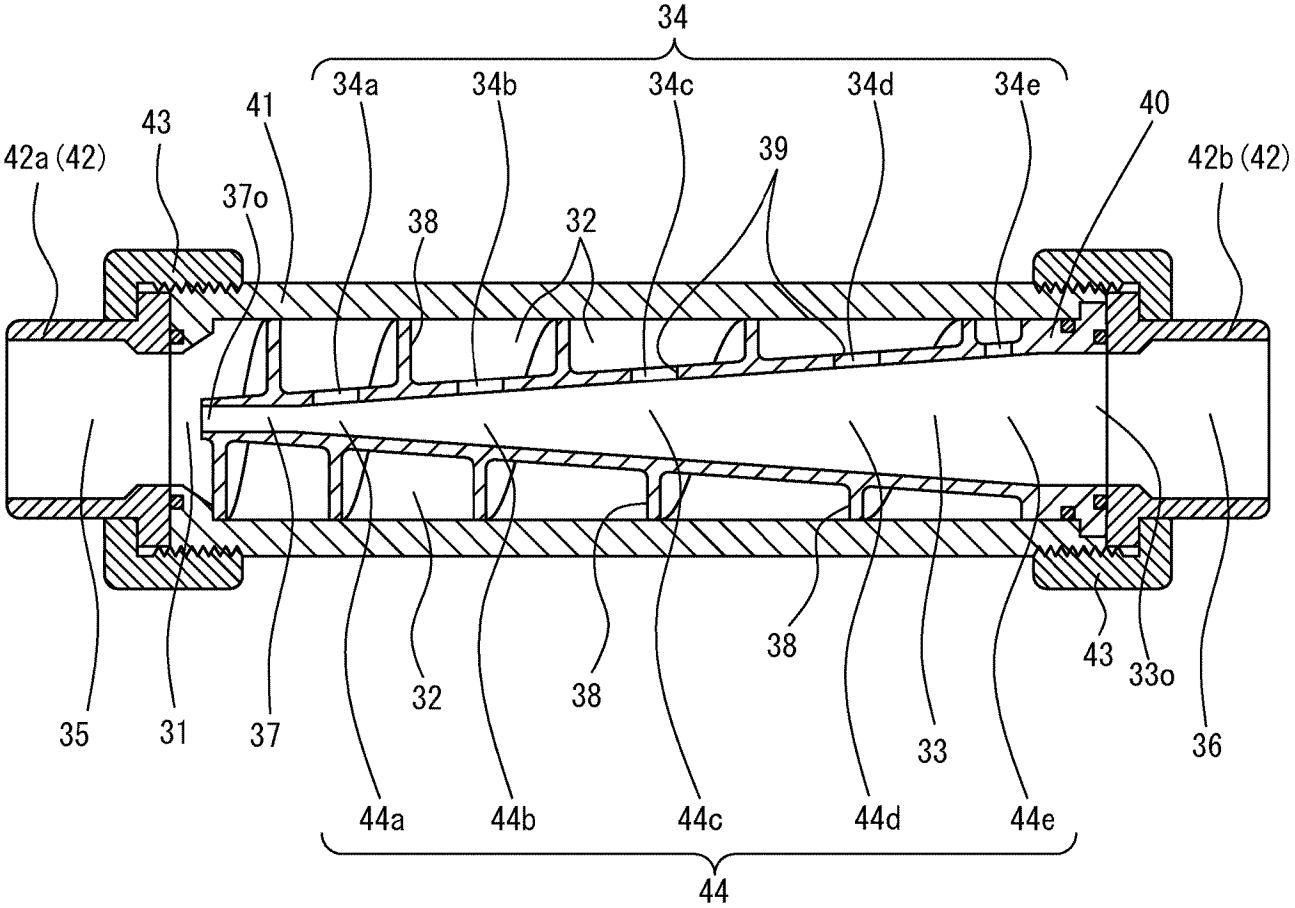
FIG. 6 is a vertical cross-sectional view illustrating the general configuration of a fluid mixer according to a third embodiment of the present invention.
Figure 7:
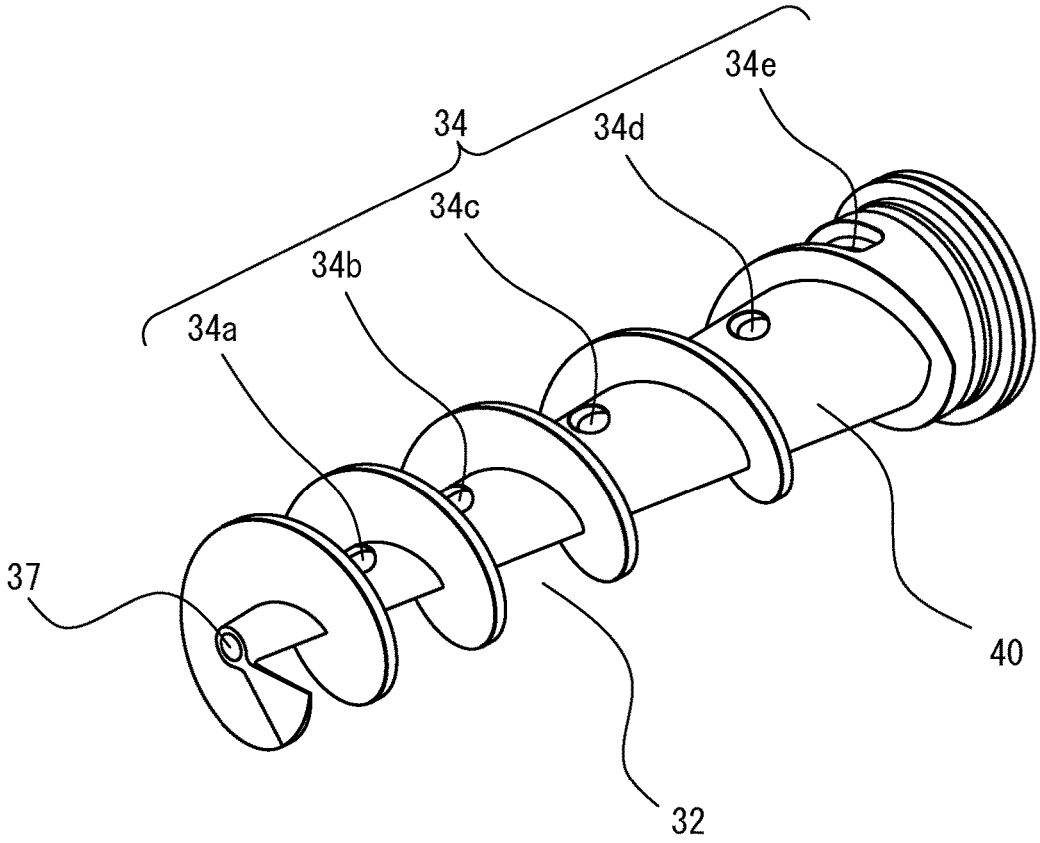
FIG. 7 is a perspective view of a body according to the third embodiment of the present invention.

6-7. FIG. 6 is a vertical cross-sectional view illustrating the general configuration of a fluid mixer according to the third embodiment. FIG. 7 is a perspective view of a body according to the third embodiment. The third embodiment differs from the second embodiment mainly in the configuration of a helical groove 38. In other words, in the third embodiment, the helical groove 38 on the outer peripheral surface of a body 40 extends from one end surface of the body 40 to the other end surface of the body 40. The differences from the second embodiment will be mainly described.

The body 40 is made of, for example, PVC (polyvinyl chloride). In the third embodiment, the body 40 has a cylindrical shape and includes an opening 37*o* at one end surface of the body 40 and a communicating channel 37 that is connected to the opening 37*o*. The body 40 further includes an opening 40*o* at the other end surface of the body 40 and a second channel 33 that has a cross-sectional area progressively increasing from one end of the channel to the other end of the channel and that is connected to the opening 40*o*. The cross-sectional area of the second flow channel 33 at respective connections 44*a*-44*e* in which the fluid flows into the second channel 33 from branch channels 34*a*-34*e* is substantially equal to the sum of the cross-sectional areas of the branch channels 34*a*-*e* at the connection 44 in which the fluid has flowed into the second channel 33 before reaching the respective connections 44*a*-*e* added to the cross-sectional area of the communicating channel 37. For example, the cross-sectional area of the second flow channel 33 at the connection 44*e* is substantially equal to the sum of the cross-sectional areas of the respective branch channels 34*a*-34*d* at the respective connections 44*a*-44*d* added to the cross-sectional area of the communicating channel 37. On the outer peripheral surface of the body 40, the helical groove 38 extends from one end surface of the body 40 toward the other end surface of the body 40. The helical groove 38 terminates short of the other end. The end of the helical groove 38 is oriented orthogonally to the longitudinal direction of the body 40. The downstream side of the helical groove 38 tapers narrower toward the end. The helical groove 38 is progressively shallower from one end toward the other end and is progressively wider from one end toward the other end. On the bottom surface of the helical groove 38, communication holes 39 are formed. The communication holes 39 constitute a plurality of branch channels 34 that allow the helical groove 38 to communicate with the second channel 33.

A cylindrical casing 41 is made of, for example, PVC. In the third embodiment, the cylindrical casing 41 is cylindrically shaped. The cylindrical casing 41 has an inner diameter that is approximately the same as the outer diameter of the body 40 and has a central axis that is coaxial with the central axis of the body 40. To connect the fluid mixer to external tubing, cylindrically shaped joints 42*a* and 42*b* are abutted to the ends of the cylindrical casing 41 via a water stop member and are fixed and sealed by cap nuts 43. The cylindrical casing 41, the joints 42*a* and 42*b*, and the cap nuts 43 constitute a housing for the fluid mixer. An opening in the joint 42*a* that is connected to one end surface of the cylindrical casing 41 constitutes a fluid inlet 35, and a channel that extends from the opening in the joint 42*a* to one end of the cylindrical casing 41 constitutes a first channel 31. An opening in the joint 42*b* that is connected to the other end surface of the cylindrical casing 41 constitutes a fluid outlet 36, and a channel formed in the joint 42*b* constitutes a part of the second channel 33. Other configurations of the body 40 in the third embodiment are similar to those of the second embodiment and thus are not described here.

Next, the operation of the fluid mixer according to the third embodiment of the present invention will be described.

The fluid that has a portion of a higher concentration of the chemical solution enters the first channel 31 through the fluid inlet 35 and then flows downstream. When the fluid flows downstream, the fluid in the first channel 31 is divided into the communicating channel 37 and the helical channel 32, and each of the divided fluid streams flows through the respective channel. The fluid in the communicating channel 37 flows into the second channel 33 and then exits the fluid outlet 36 earlier than the fluid in the helical channel 32. When the fluid enters the second channel 33 through the communicating channel 37, a pressure loss can be decreased, because the communicating channel 37, the second channel 33, and the fluid outlet 36 are disposed coaxially. As the communicating channel 37 and the second channel 33 connect the fluid inlet 35 to the fluid outlet 36 at the shortest distance, the fluid that flows through the communicating channel 37 and the second channel 33 to the fluid outlet 36 is rapidly discharged from the fluid mixer.

The fluid that does not flow into the communicating channel 37 enters the helical channel 32. The helical groove 38 extends from one end surface of the body 40 and can direct the fluid to the helical channel 32 without significantly changing the direction of the fluid flowing through the first channel 31. Thus, when the fluid enters the helical channel 32, a pressure loss can be decreased, and the fluid can smoothly flow from the first channel 31 into the helical channel 32.

The fluid in the helical channel 32 is divided into the helical channel 32 and the respective branch channels 34, every time the fluid reaches the communication holes 39, which constitute the branch channels 34, while the fluid is flowing downstream. Because the helical channel 32 is progressively wider toward the downstream direction, decrease in the cross-sectional area of the helical groove 38 can be prevented, and the flow rate of the fluid in the helical channel 32 can be constrained. The fluid in the helical channel 32 enters the branch channels 34 in portions, every time the fluid passes through the connections to the branch channels 34, and thus the volume of the fluid in the helical channel 32 progressively decreases toward the downstream end. In other words, when the fluid flows through the helical groove 38 that is progressively wider toward the downstream end while the fluid in the helical channel 32 is decreasing in volume, the flow rate of the fluid in the helical channel 32 is decreased every time the fluid passes through the connections to the branch channels 34. Thus, a difference is created between the length of time that the fluid in the helical channel 32 takes to flow through the respective branch channels 34 into the second channel 33 and the length of time that the fluid takes to flow from the communicating channel 37 to the second channel 33.

The fluid streams that flow through the communicating channel 37 or the branch channels 34 into the second channel 33 further flows downstream toward the fluid outlet 36. Because the cross-sectional area of the second channel 33 progressively increases from the fluid inlet 35 toward the fluid outlet 36, a pressure loss can be decreased, even when the volume of the fluid that enters the second channel 33 increases. Then the fluid in the second channel 33 smoothly flows toward the fluid outlet 36. The cross-sectional area of the second channel 33 at the respective connections 44 between the plurality of branch channels 34 and the second channel 33 is substantially equal to the sum of the cross-sectional areas of the branch channels 34 at the connections 44 in which the fluid passes into the second channel 33 before reaching the respective connections 44 added to the cross-sectional area of the communicating channel 37. Thus, the flow rate of the fluid that flows through the communicating channel 37 and the branch channels 34 into the second channel 33 can be increased, and the fluid in the second channel 33 smoothly flows toward the fluid outlet 36. The mechanism for achieving an even and uniform concentration profile in the direction of flow of the fluid in third embodiment is similar to that of the first embodiment and the second embodiment and thus is not described here.

In the third embodiment, the flow rate of the fluid before entering the second channel 33 (especially, the fluid that flows through the helical channel 32) is constrained to increase the length of time that the fluid takes to reach the respective branch channels 34. On the other hand, the flow rate of the fluid after entering the second channel 33 is increased to decrease the length of time that the fluid that flows through the communicating channel 37 and the branch channel 34 into the second channel 33 takes to exit the fluid outlet 36. Such configurations can increase the difference between the length of time that the fluid in the communicating channel 37 takes to exit the fluid mixer and the length of time that the fluid in the branch channels 34 takes to exit the fluid mixer, thereby more effectively achieving an even and uniform concentration profile in the flow direction.

Fourth Embodiment

Figure 8:
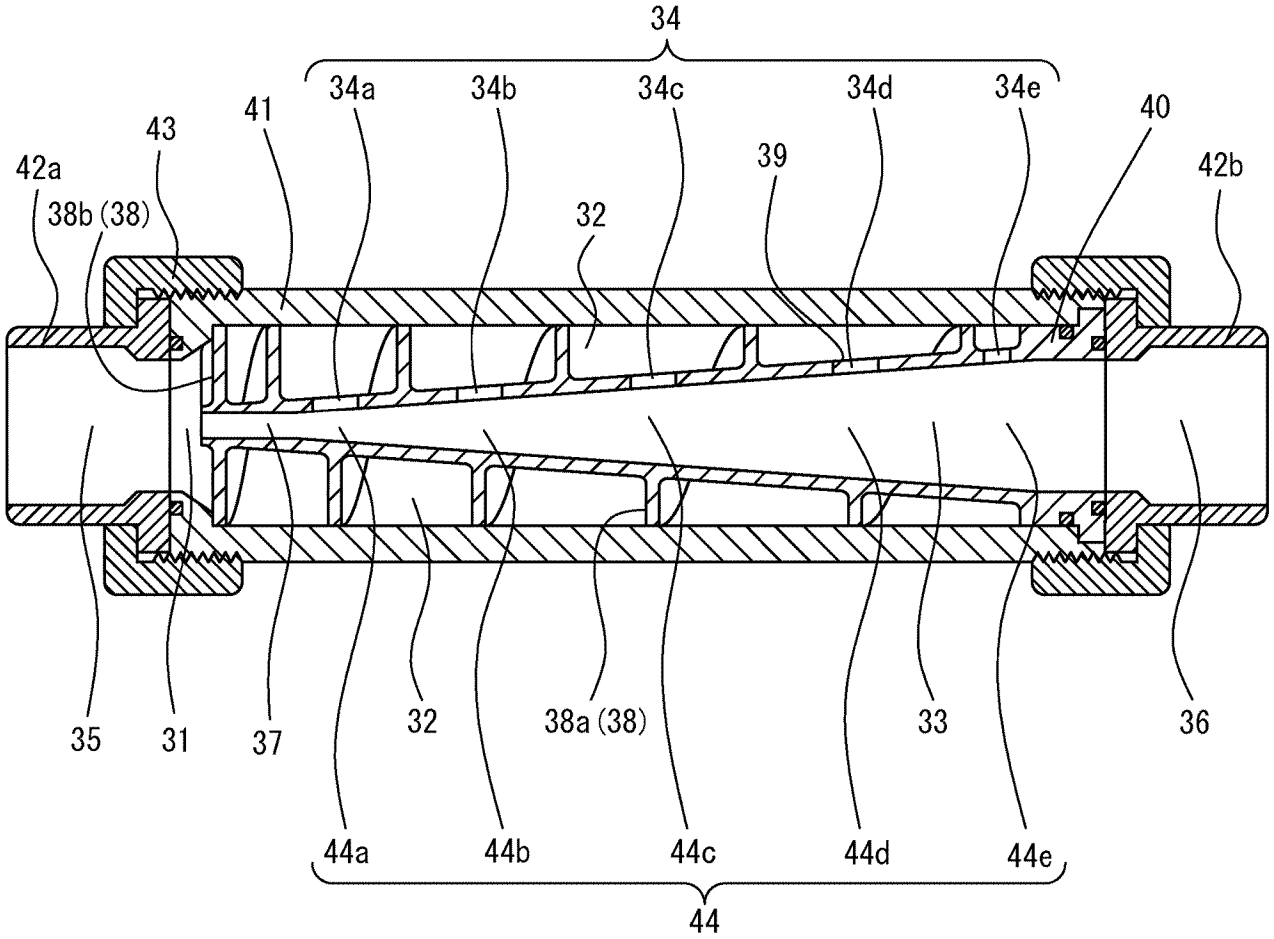
FIG. 8 is a vertical cross-sectional view illustrating the general configuration of a fluid mixer according to a fourth embodiment of the present invention.
Figure 9:
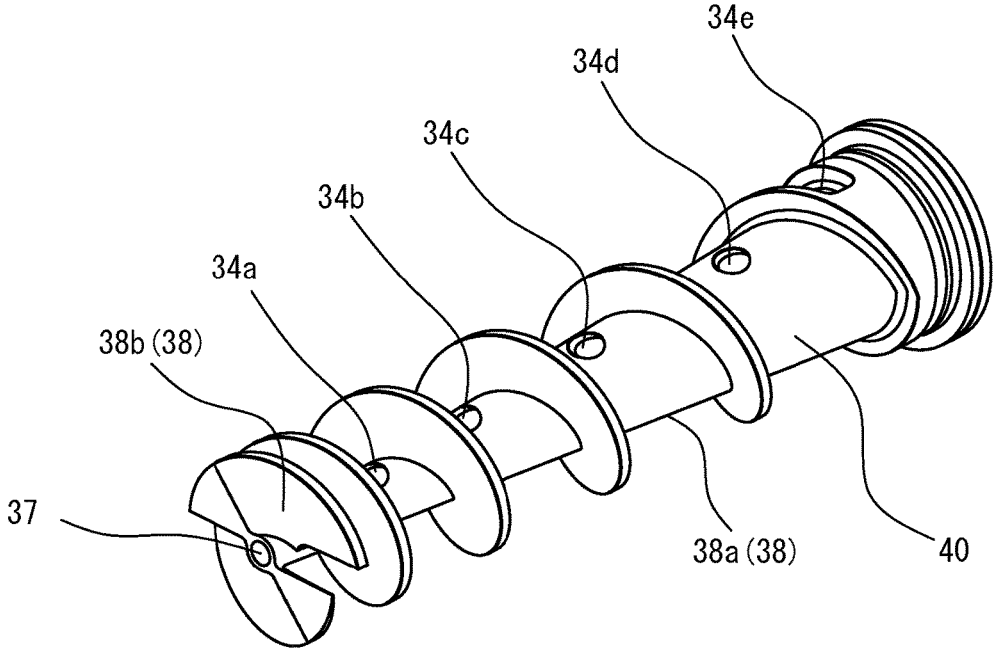
FIG. 9 is a perspective view of a body according to the fourth embodiment of the present invention.

A fluid mixer according to a fourth embodiment of the present invention will be described with reference to FIGS. 8-9. FIG. 8 is a vertical cross-sectional view illustrating the general configuration of the fluid mixer according to the fourth embodiment. FIG. 9 is a perspective view of a body according to the fourth embodiment. The fourth embodiment differs from the third embodiment mainly in the configuration of a helical groove 38. In other words, in the fourth embodiment, the plurality of helical grooves 38 are formed on the outer peripheral surface of the body 40. Note that elements identical to those in FIGS. 6-7 have the same reference number. The differences from the third embodiment will be mainly described.

Figure 10:
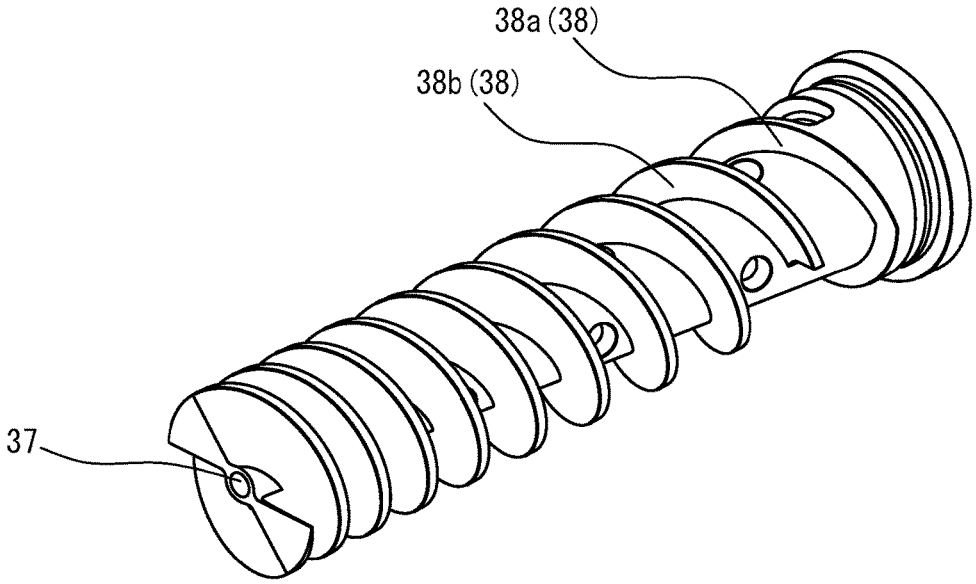
FIG. 10 is a perspective view of a body according to a modified example of the fourth embodiment of the present invention.

The body 40 is made of, for example, PVC. On the outer peripheral surface of the body 40, the plurality of helical grooves 38 extend from one end surface of the body 40 to the other end of the body 40. The plurality of helical grooves 38, in particular, two helical grooves 38 in the fourth embodiment, are circumferentially offset with respect to each other. In other words, the helical grooves 38 are disposed at regular intervals in the longitudinal direction of the body 40 and offset with respect to each other so that the helical grooves 38 are alternated. One of the plurality of helical grooves 38, which is a helical groove 38*a*, extends to one end of the body 40, the other of the helical grooves 38, which is a helical groove 38*b*, extends so that the helical groove 38*b* has a length shorter than the length of the helical groove 38*a*. The helical groove 38*b* extends almost one-half around the outer circumference of the body 40, and the helical groove 38*b* joins the helical groove 38*a* at the end of the helical groove 38*b*. The helical groove 38*b* is formed so that the helical groove 38*b* has a length shorter than the length of the helical groove 38*a*. The helical groove 38*b* may extend proximally to the other end without limitation, as in the body according to a modified example of the fourth embodiment illustrated in FIG. 10. Provision of the plurality of the helical grooves 38 can increase the contact area between the cylindrical casing 41 and the body 40, thereby preventing damage to the side walls of the helical grooves 38. This is especially beneficial when one end of the body 40 is abutted against the cylindrical casing 41 to fit the body 40 into the cylindrical casing 41. In the fourth embodiment, the plurality of helical grooves 38 have the same configuration, although the grooves may differ in, for example, their width, their depth, the shape of their bottom surface, the number of communication holes 39, without limitation. By providing the plurality of helical grooves 38 that have different configurations from each other, the flow rate of the fluid in the respective helical grooves 38 may be adjusted. Other configurations of the body 40 and components other than the body 40 such as the cylindrical casing 41 in the fourth embodiment are similar to those of the third embodiment and thus are not described here.

Next, the operation of the fluid mixer according to the fourth embodiment of the present invention will be described.

The fluid that has a portion of a higher concentration of the chemical solution enters the first channel 31 through the fluid inlet 35 and then flows downstream. When the fluid flows downstream, the fluid is divided into the communicating channel 37 and the helical channels 32. As there are a plurality of helical channels 32, and the plurality of helical channel 32 join together in an intermediate part, the fluid streams in the helical channels 32 collide with each other, thereby promoting mixing to achieve an even and uniform concentration profile along the diameter direction. The mechanism for achieving an even and uniform concentration profile in the direction of flow of the fluid and the mechanism for increasing the difference between the length of time that the fluid in the communicating channel 37 takes to exit the fluid outlet 36 and the length of time that the fluid in the branch channels 34 takes to exit the fluid outlet 36 in the fourth embodiment are similar to those of the embodiments described above and thus are not described here.

Next, a system using a fluid mixer as described above will be described with reference to FIG. 11 and FIG. 12.

The fluid mixer according to the embodiments of the present invention is disposed, for example, in a line through which fluid flows while varying its temperature or concentration over time. In other words, the fluid mixer according to the embodiments of the present invention is used for, for example, fluid that is heated by a heater disposed in a line and that thus varies its temperature over time and fluid that is allowed to flow through a line where a solid dissolves out into the fluid and that thus varies in its concentration over time. Use of the fluid mixer allows for a uniform temperature or concentration of the fluid that flows through the line. The substance that allows to flow through the fluid mixer may be any gas or fluid without limitation.

Figure 11:
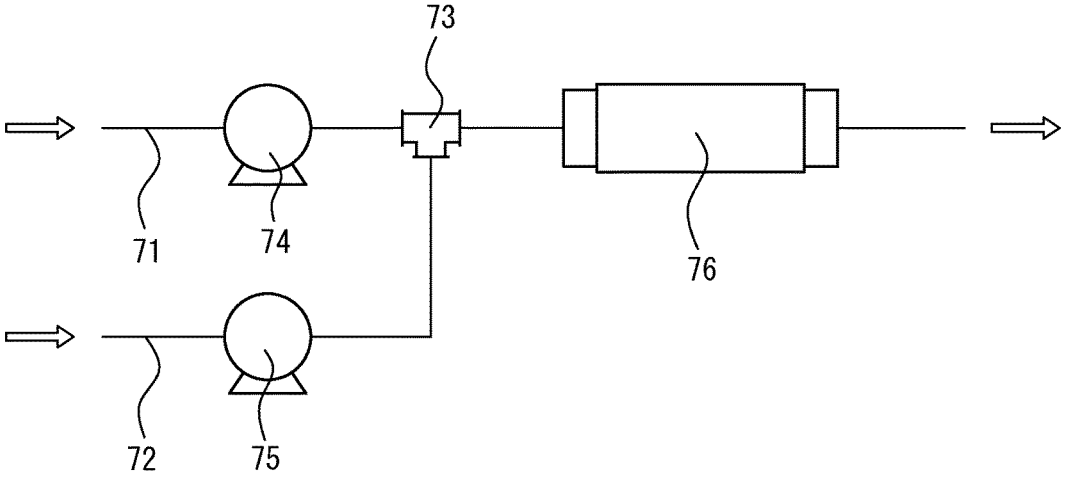
FIG. 11 is a schematic view of a system using the present fluid mixer, according to an embodiment of the present invention.

FIG. 11 illustrates an example of a system using a fluid mixer according to the present invention. In FIG. 11, a fluid mixer 76 according to the present invention is disposed downstream of a connection 73 between lines 71 and 72 through which two different substances flow. The substances are provided by respective pumps 74 and 75, and thus pulsations generated by the pumps 74 and 75 may vary the mixture ratio of the substances over time. The fluid mixer 76 can equalize the mixture ratio and provide a uniform temperature or concentration over time. The fluid mixer is also beneficial, for example, when a high temperature substance and a low temperature substance are fed to the line 71 and the line 72, respectively, and, for example, the high temperature substance that non-uniformly flows causes a variation in temperature of the combined fluid over time, or when a fluid substance having a predetermined concentration is combined with another fluid substance, and the combined fluid has a varying concentration over time. In these cases, the fluid substances may be, for example, any gas, liquid, solid, or powder. The solid and powder may be previously combined with gas or liquid. The system may be configured so that lines through which three or more different substances separately flow join together and that the three or more substances are mixed by the fluid mixer.

Figure 12:
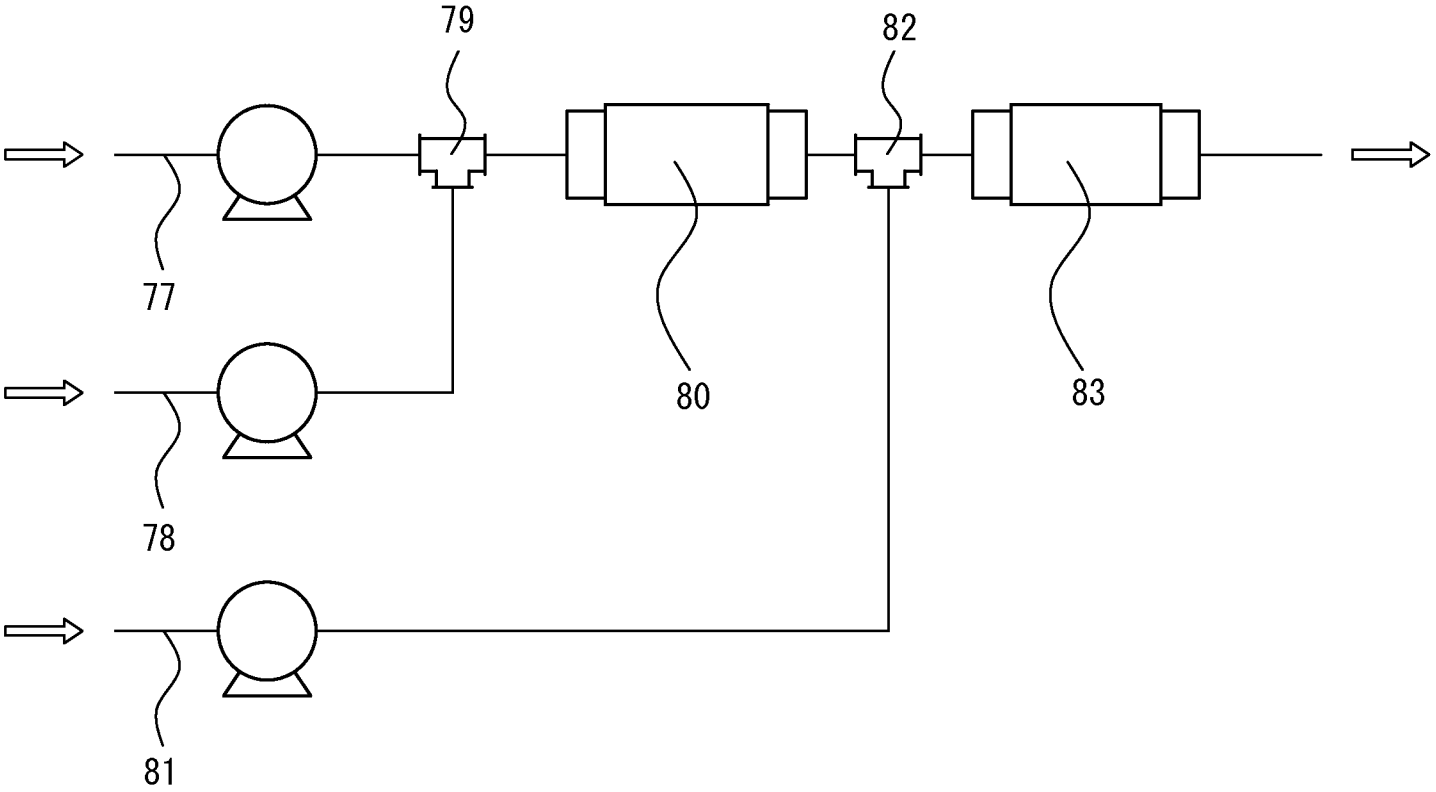
FIG. 12 is a schematic view of a system using the present fluid mixer, according to a modified example of the embodiment of the present invention.
Figure 13:
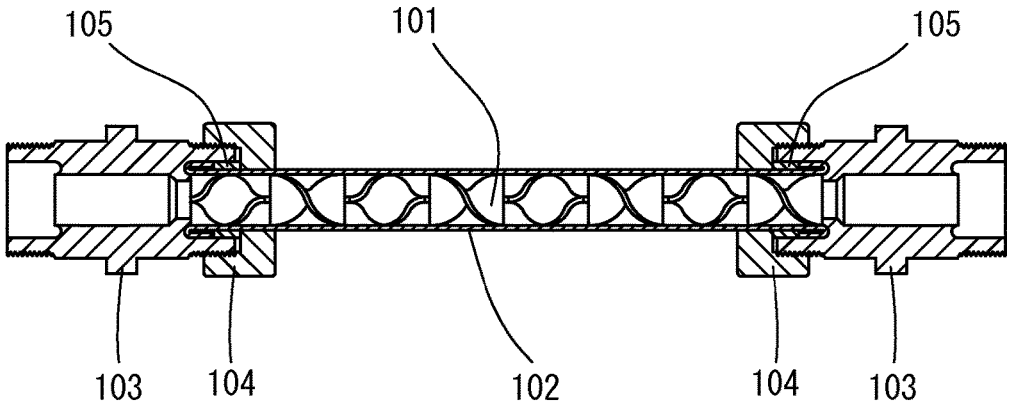
FIG. 13 is a vertical cross-sectional view of a conventional fluid mixer.
Figure 14:
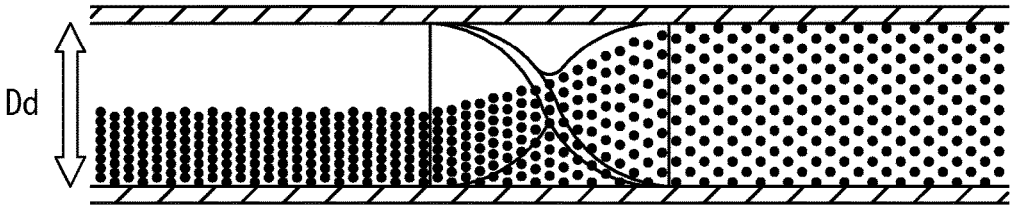
FIG. 14 is a schematic view illustrating fluid that is being agitated by the static mixer of FIG. 13.
Figure 15:
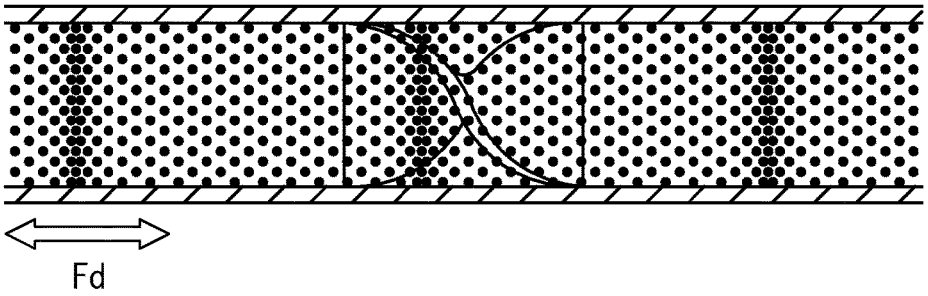
FIG. 15 is a schematic view illustrating fluid that is being agitated by the static mixer of FIG. 13.

FIG. 12 illustrates a modified example of the system of FIG. 11. In FIG. 12, a fluid mixer 80 according to the present invention is disposed downstream of a connection 79 between lines 77 and 78 through which two different substances separately flow. And downstream of the fluid mixer 80, a connection 82 to a line 81 through which another substance flow is disposed. Downstream of the connection 82, a fluid mixer 83 according to the present invention is disposed. Although simultaneous combination of three or more substances may cause a large variation, when two substances are first combined and mixed until homogeneous, and then the combined substances are combined with another substance and mixed until homogeneous, the substances can be evenly and uniformly mixed in an efficient manner. For example, when water, oil, and surfactant are combined at once, the substances are poorly mixed, resulting in a variation. Thus, after combining water with surfactant, the resultant combination can be combined with oil, and the resultant combination can be mixed to provide an even and uniform mixture. The system can be suitably used when water and sulfuric acid is combined and diluted, and then the resultant combination is combined with ammonia gas to allow the combination to absorb the ammonia gas, or when water and sulfuric acid are combined and diluted, and the resultant combination is combined with soda silicate to adjust the pH. It is possible to first combine three or more substances and then to combine the resultant combination with the other two or more substances. It is also possible to arrange three or more fluid mixers in series to sequentially mix the substances.

Combinations of different fluid substances mixed by the present system will be further described. In the system of FIG. 11, water may be fed to the line 71 for one substance, and any of pH adjuster, liquid fertilizer, bleach, bactericide, surfactant, or chemical solution may be fed to the line 72 for the other substance.

In this case, the water may be any water without limitation, such as pure water, distilled water, tap water, and industrial water as long as the water is compatible with the substance to be combined. The water may have any temperature without limitation and thus may be warm water or cold water. The pH adjuster may be acid or alkali used to adjust the pH of the substance to be combined. Examples of the pH adjuster include hydrochloric acid, sulfuric acid, nitric acid, hydrofluoric acid, carboxylic acid, citric acid, gluconic acid, succinic acid, potassium carbonate, sodium hydrogen carbonate, and aqueous sodium hydroxide. The liquid fertilizer may be any agricultural liquid fertilizer, including soil and chemical fertilizer.

The bleach may be any bleach as long as it degrades a pigment using the oxidation or reduction reaction of a chemical substance. Examples of the bleach include sodium hypochlorite, sodium percarbonate, hydrogen peroxide, ozone water, thiourea dioxide, and sodium dithionite. The bactericide is an agent for killing pathogenic or hazardous microorganisms. Examples of the agent include tincture of iodine, povidone iodine, sodium hypochlorite, chlorinated lime, mercurochrome solutions, chlorhexidine gluconate, acrinol, ethanol, isopropanol, aqueous hydrogen peroxide solutions, benzalkonium chloride, cetylpyridinium chloride, cresol soap solutions, sodium chlorite, hydrogen peroxide, sodium hypochlorite, aqueous hypochlorous acid solutions, and ozone water.

The surfactant is a substance that has, in the molecule, a moiety having a tendency to interact with water (hydrophilic group) and a moiety having a tendency to interact with oil (lipophilic group or hydrophobic group). Examples of the surfactant include fatty acid sodium, fatty acid potassium, monoalkyl sulfates, alkyl polyoxyethylene sulfates, alkyl benzene sulfonates, monoalkyl phosphates, alkyl trimethyl ammonium salts, dialkyl dimethyl ammonium chlorides, alkyl benzyl dimethyl ammonium salts, alkyl dimethyl amine oxides, alkylcarboxy betaines, polyoxyethylene alkyl ethers, sorbitan fatty acid esters, alkyl polyglucosides, fatty acid diethanolamides, alkyl monoglyceryl ethers, sodium alpha sulfo fatty acid esters, sodium linear alkyl benzene sulfonates, sodium alkyl sulfates, sodium alkyl ether sulfates, sodium alpha olefin sulfonates, sodium alkyl sulfonates, sucrose fatty acid esters, sorbitan fatty acid esters, polyoxyethylene sorbitan fatty acid esters, fatty acid alkanolamide, polyoxyethylene alkyl ethers, polyoxyethylene alkyl phenyl ethers, sodium salts of alkyl amino fatty acids, alkyl betaines, alkyl amine oxides, alkyl trimethyl ammonium salts, and dialkyl dimethyl ammonium chlorides.

Any chemical solution that does not fall into the categories described above may be used as long as it falls into any category of chemical solutions. Examples of such substance include hydrochloric acid, sulfuric acid, acetic acid, nitric acid, formic acid, hydrofluoric acid, sodium hydroxide, potassium hydroxide, calcium hydroxide, barium hydroxide, ammonium hydroxide, soda silicate, and oil. The chemical solutions listed here may be used as a chemical solution that falls into the categories described above. Water may be fed to the line 71 for one substance, while hot water may be fed to the line 72 for the other substance, and then the water and the hot water may be mixed to provide a water stream that has an even and uniform temperature.

Alternatively, a first chemical solution may be fed to the line 71 for one substance, while a second chemical solution or metal may be fed to the line 72 for the other substance, and then these substances may be mixed by the fluid mixer 76. The first and the second chemical solutions may be any substances as long as they can be mixed, and the chemical solutions described above or other chemical solutions may be used. Examples of the chemical solutions include, for example, photoresists and thinner. The chemical solutions may be care products. Examples of the care products include skin care products that care for skin, such as cleansers, makeup removers, toners, serums, moisturizing lotions, cream, and gel; and medicated products such as oral care products, deodorants, and formulations for rashes, sores, prevention of hair loss, hair growth, removal of unwanted hair, and rat and pest control.

The metal is mainly an organic metallic compound and is used as a solution of the fine granules or particles in, for example, an organic solvent. Examples of the organic metallic compound include organic zinc compounds such as chloro(ethoxycarbonylmethyl)zinc, organic copper compounds such as lithium dimethylcopper, organic magnesium compounds such as Grignard reagents, methyl magnesium iodide, and diethyl magnesium, organic lithium compounds such as n-butyllithium, organic metallic compounds such as metal carbonyl, carbene complexes, and metallocenes including ferrocene, and solutions of a single- or multi-element standard in paraffin oil. Examples of the metal include compounds of semimetals such as silicon, arsenic, and boron, and base metals such as aluminum. The organic metallic compounds are suitably used as a catalyst for, for example, the production of petrochemicals and of organic polymers.

Alternatively, liquid waste may be fed to the line 71 for one substance, while a pH adjuster or flocculating agent is fed to the line 72 for the other substance, and then these substances may be mixed by the fluid mixer 76. The pH adjuster may be, for example, any of the pH adjusters listed above, and the flocculating agent may be any flocculating agent without limitation as long as it can flocculate the liquid waste. Examples of the flocculating agent include aluminum sulfate, polyferric sulphate, polyaluminum chloride, poly silicate iron, calcium sulfate, ferric chloride, and slaked lime. Any microorganisms may be use as long as they can facilitate fermentation or degradation of the liquid waste. Examples of the microorganisms include fungi such as molds and yeast, and microbes such as bacteria.

Alternatively, a first petroleum product may be fed to the line 71 for one substance, a second petroleum product, an additive, or water may be fed to the line 72 for the other substance, and then these substances may be mixed by the fluid mixer 76. The first and second petroleum products refer to liquid oil that contains a hydrocarbon as a major component and a small amount of other various substances such as sulfur, oxygen, and nitrogen. Examples of the petroleum products include naphtha (gasoline), kerosene, diesel oil, fuel oil, lubricant, and asphalt. The additive as used herein refers to a substance that is added to improve or maintain the quality of the petroleum products. Examples of the additive include detergent dispersants, antioxidants, viscosity index improvers, pour point depressants, oiliness improvers, extreme pressure agents, antiwear agents, rust inhibitors, and anticorrosives, which are for lubricant, structure stabilizing agents and fillers for grease, and additives for fuel oil. As used herein, water may be any water such as pure water, distilled water, tap water, and industrial water as long as the water is compatible with the substance to be combined. The water may have any temperature without limitation and may be warm water or cold water.

Alternatively, a first resin may be fed to the line 71 for one substance, while a second resin, a solvent, a curing agent, or a coloring agent may be fed to the line 72 for the other substance, and then these substances may be mixed by the fluid mixer 76. As used herein, the resin refers to a major component of an adhesive or a film forming component for a paint, such as a molten resin and a liquid resin. The molten resin may be any molten resin without limitation as long as it can be injection-molded or extrusion-molded. Examples of the molten resin include polyethylenes, polypropylenes, polyvinyl chlorides, polystyrenes, tetrafluoroethylene-perfluoroalkylvinylether copolymers, ABS resins, acrylic resins, polyamides, nylons, polyacetals, polycarbonates, modified polyphenylene ethers, polybutylene terephthalates, polyethylene terephthalates, polyphenylene sulfides, and polyether ether ketones.

Examples of the adhesive that contains a liquid resin as a major component include acrylic resin based adhesives, α-olefin based adhesives, urethane resin based adhesives, ether based cellulose, ethylene-vinyl acetate resin adhesives, epoxy resin based adhesives, vinyl chloride resin solvent based adhesives, chloroprene rubber based adhesives, vinyl acetate resin based adhesives, cyanoacrylate based adhesives, silicone based adhesives, aqueous polymer-isocyanate based adhesives, styrene-butadiene rubber solution based adhesives, styrene-butadiene rubber based latex adhesives, nitrile rubber based adhesives, nitrocellulose adhesive, reactive hot-melt adhesives, phenol resin based adhesives, modified silicone based adhesives, polyamide resin hot-melt adhesives, polyimide based adhesives, polyurethane resin hot-melt adhesives, polyolefin resin hot-melt adhesives, polyvinyl acetate resin solution based adhesives, polystyrene resin solvent based adhesives, polyvinyl alcohol based adhesives, polyvinyl pyrrolidone resin based adhesives, polyvinyl butyral resin based adhesives, polybenzimidazole adhesive, polymethacrylate resin solution based adhesives, melamine resin based adhesives, urea resin based adhesives, and resorcinol based adhesives. Examples of the film forming component for a paint include acrylic resins, urethane resins, and melamine resins.

Examples of the solvent include hexane, benzene, toluene, diethyl ether, chloroform, ethyl acetate, tetrahydrofuran, methylene chloride, acetone, acetonitrile, dimethylsulfoxide, dimethylformamide, dimethylacetamide, N-methylpyrrolidone, ethanol, and methanol. Examples of the curing agent include polyamines, acid anhydrides, amines, peroxide, and saccharin. Examples of the coloring agent include pigments such as Chinese white, white lead, lithopone, titanium dioxide, precipitated barium sulfate, barytes, red lead, red iron oxide, chrome yellow, zinc yellow, ultramarine blue, potassium ferric ferrocyanide, and carbon black.

When the resin is a molten resin, the system may be configured to feed the molten resin from a molding machine or an extruding machine to the fluid mixer 76. For example, when a molding machine is used to injection-mold the resin, the fluid mixer 76 may be disposed between a nozzle and a mold of the molding machine. When an extruding machine is used to extrusion-mold the resin, the fluid mixer 76 may be disposed between the extruding machine and a die. In this case, the system can provide a uniform temperature with the resin stream and stabilize the viscosity of the resin to reduce thickness variations and internal stress, as well as color variations.

Alternatively, a first food ingredient may be fed to the line 71 for one substance, while a second food ingredient, a food additive, condiments, nonflammable gas, or the like may be fed to the line 72 for the other substance, and then these substances may be mixed by the fluid mixer 76.

The first and second food ingredients may be any drink or food as long as it can flow through the tubing. Examples of the ingredients include liquor such as sake, distilled spirit, beer, whiskey, wine, and vodka, dairy products such as milk, yogurt, butter, cream, cheese, condensed milk, and dairy cream, beverages such as juice, tea, coffee, soya milk, and water, soup such as soup stock, miso soup, consomme, corn soup, and pork bone broth, and various other foods such as jelly, konjac, pudding, chocolate, ice cream, candies, tofu, fish cakes, beaten egg, and gelatin. Solid or particles may also be used as long as it is flowable. Examples of the solid and the particles include powdered products such as wheat flour, potato starch, hard wheat flour, soft wheat flour, buckwheat flour, dry milk, ground coffee beans, and cocoa powder, and small solid foods such as fruit pulp, wakame seaweed, sesame seeds, green laver, flaked bonito, bread crumbs, and finely-chopped or grated foods.

Examples of the food additive include sweeteners such as brown sugar lump, soft brown sugar, fruit sugar, malt sugar, honey, treacle, maple syrup, starch syrup, erythritol, trehalose, maltitol, palatinose, xylitol, sorbitol, thaumatin, sodium saccharin, cyclamates, dulcin, aspartame, acesulfame potassium, sucralose, and neotame, coloring such as caramel coloring, gardenia coloring, anthocyanin coloring, annatto coloring, paprika coloring, safflower coloring, monascus coloring, flavonoid coloring, cochineal coloring, amaranth, erythrocin, allura red AC, new coccine, phloxin, rose bengal, acid red, tartrazine, sunset yellow FCF, fast green FCF, brilliant blue FCF, and indigocarmine, preservatives such as sodium benzoate, ε-polylysine, soft roe protein extract (protamine), potassium sorbate, sodium sorbate, sodium dehydroacetate, and thujaplicin (hinokitiol), antioxidants such as ascorbic acid, tocopherol, dibutylhydroxytoluene, butylhydroxyanisol, sodium erythorbate, sodium sulfite, sulfur dioxide, chlorogenic acid, and catechin, and flavoring.

Examples of the condiments include liquid condiments such as soy sauce, sauce, vinegar, oil, chili oil, miso, ketchup, mayonnaise, dressing, and mirin (sweet sake), and powder condiments such as sugar, salt, pepper, Japanese pepper, and cayenne pepper. Some microorganisms facilitate fermentation or degradation of foods. Examples of such microorganisms include fungi such as mushrooms, molds, and yeast, and microbes such as bacteria. Examples of the fungi include various mushrooms and aspergilli. Examples of the microbes include, for example, bifidobacteria, lactic acid bacteria, and *bacillus natto*. Examples of the nonflammable gas include carbon dioxide. For example, carbon dioxide is mixed with wort to produce beer.

Alternatively, air may be fed to the line 71 for one substance, while flammable gas may be fed to the line 72 for the other substance, and then these substances may be mixed by the fluid mixer 76. Examples of the flammable gas include methane, ethane, propane, butane, pentane, acetylene, hydrogen, carbon monoxide, ammonia, and dimethyl ether.

Alternatively, first nonflammable gas may be fed to the line 71 for one substance, while second nonflammable gas or vapor may be fed to the line 72 for the other substance, and then these substances may be mixed by the fluid mixer 76. Examples of the nonflammable gas include nitrogen, oxygen, carbon dioxide, argon gas, helium gas, hydrogen sulfide gas, sulfurous acid gas, and sulfur oxide gas. In addition to the combinations described above, water, a liquid chemical solution, or a food ingredient may be fed to the line 71 for one substance, while air, nonflammable gas, or vapor may be fed to the line 72 for the other substance, and then these substances may be mixed by the fluid mixer 76.

Alternatively, a first synthetic intermediate may be fed to the line 71 for one substance, while a second synthetic intermediate, an additive, a liquid chemical solution, metal, or the like may be fed to the line 72 for the other substance, and then these substances may be mixed by the fluid mixer 76. The first and second synthetic intermediates refer to a compound that is produced during a stage of a multistage synthetic route before a target compound is produced. Examples of the first and second synthetic intermediates include intermediates produced by mixing a plurality of chemical solutions, resin intermediates, and pharmaceutical intermediates.

The system of FIG. 12 may be used to mix the combinations of different fluid substances as described above. In the system using the fluid mixer as illustrated in FIG. 11 or FIG. 12, a heater or vaporizer may be disposed in respective lines through which the uncombined fluid substances flow, and a heat exchanger may be disposed downstream of the fluid mixer. Additionally, a gauge may be disposed in a line through which one uncombined fluid substance flows. And a control unit may be provided, the unit adjusting the output of a pump in a line through which the other fluid substance flows in response to a parameter indicated by the gauge. In the line through which the other fluid substance flows, a control valve may be disposed, the valve adjusting the degree of openness of the valve in response to a parameter indicated by the gauge. The gauge may be any flowmeter, current meter, a concentration meter, or a pH meter as long as it can measure a necessary fluid parameter. A static mixer may be disposed in a channel downstream of the connection between the lines. In this case, as the fluid mixer mixes the substances along the axis direction of the channel, and then for example, a static mixer as described at the beginning of this specification mixes the substances in the diameter direction of the channel, the substances can be more uniformly mixed.

Various components of the fluid mixer according to the present invention, such as the bodies 20 and 40 and the cylindrical casings 21 and 41 may be made of any resin such as PVC, polypropylene, and polyethylene. Especially when corrosive fluid is used, the resin is preferably a fluororesin such as PTFE, PFA, and polyvinylidene fluorides. When the components are made of fluororesin, the mixer can be used for corrosive fluid, and such mixer is suitable because concern about corrosion of the tube materials is eliminated even when corrosive gas flows through the mixer. All or part of the body or the housing may be made of a transparent or semitransparent material. Such a configuration is suitable because the operators can visually confirm the state of mixing the fluid. Depending on the substances to be fed to the fluid mixer, each of the components may be made of metal or metal alloys such as iron, copper, copper alloys, brass, aluminum, stainless steel, and titanium.

Although the helical channels 2, 12, and 32 have a circular shape in the embodiments described above, the helical channels may have any other shape (for example, a rectangular shape) as long as they are wound around the circumference of the main channel. Although the helical groove 18 or 38 is disposed on the outer peripheral surface of the body 20 or 40, respectively, in the embodiments described above, the helical groove 18 or 38 may disposed at another location (for example, on the inner peripheral surface of the cylindrical casing 21 or 41) as long as the helical channel 12 or 32 is formed between the body 20 or 40 and the cylindrical casing 21 or 41, respectively. Alternatively, a cylindrical helix component that has a hole may be interposed between the body 20 or 40 and the cylindrical casing 21 or 41.

The features of the first to fourth embodiments described above may be combined as desired to configure a fluid mixer. In other words, the present invention is not limited to the fluid mixers according to the embodiments as long as the features and the functions of the present invention can be achieved.

DESCRIPTION OF THE REFERENCE NUMERAL

1, 11, 31 first channel

2, 12, 32 helical channel

3, 13, 33 second channel

4, 14, 34 branch channel

5, 15, 35 fluid inlet

6, 16, 36 fluid outlet

7, 17, 37 communicating channel

20, 40 body

21, 41 cylindrical casing

The invention claimed is:

1. A fluid mixer comprising:

a fluid inlet, a first channel that is connected to the fluid inlet, a helical channel that is connected to the first channel, a plurality of branch channels that diverge from the helical channel, a second channel that is connected to the plurality of branch channels, a communicating channel that allows the first channel to communicate with the second channel, and a fluid outlet that is connected to the second channel, wherein the plurality of branch channels each diverge from the helical channel at different locations in the flow direction, and the plurality of branch channels that diverge from the helical channel are each connected to the second channel at different locations in the flow direction, the fluid mixer further comprising:

a body that comprises, inside of the body, the first channel, the second channel, the communicating channel and the branch channels, and that comprises, on the outer peripheral surface of the body, a helical groove that allows the first channel to communicate with the branch channels, and a housing that has an inner peripheral surface that forms the helical channel with the helical groove when the housing fits over the outer peripheral surface of the body, wherein the first channel, the second channel and the communicating channel are coaxially disposed with each other, wherein a plurality of the helical grooves are disposed on the outer peripheral surface of the body, wherein the helical grooves are circumferentially offset with respect to each other, and wherein at least one of the plurality of helical grooves has a length that is shorter than the length of the other helical groove(s), and a terminal end of the shorter helical groove joins the other helical groove(s).

2. The fluid mixer according to claim 1, wherein the helical groove is progressively wider from the fluid inlet side toward the fluid outlet side.

3. The fluid mixer according to claim 1, wherein the second channel has a cross-sectional area that progressively increases from the fluid inlet side toward the fluid outlet side, and wherein the cross-sectional area of the second channel at respective connections between the plurality of the branch channels and the second channel is equal to or smaller than the sum of the cross-sectional areas of the branch channels at the connections in which fluid has flowed into the second channel before reaching the respective connections and the cross-sectional area of the communicating channel.

4. A system using a fluid mixer, the system comprising:

the fluid mixer according to claim 1, and flow channel forming means for forming flow channels that combine and direct a plurality of different fluids.

5. The fluid mixer according to claim 2, wherein the second channel has a cross-sectional area that progressively increases from the fluid inlet side toward the fluid outlet side, and wherein the cross-sectional area of the second channel at respective connections between the plurality of the branch channels and the second channel is equal to or smaller than the sum of the cross-sectional areas of the branch channels at the connections in which fluid has flowed into the second channel before reaching the respective connections and the cross-sectional area of the communicating channel.

6. A fluid mixer comprising:

a fluid inlet, a first channel that is connected to the fluid inlet, a helical channel that is connected to the first channel, a plurality of branch channels that diverge from the helical channel, a second channel that is connected to the plurality of branch channels, a communicating channel that allows the first channel to communicate with the second channel, and a fluid outlet that is connected to the second channel, wherein the plurality of branch channels each diverge from the helical channel at different locations in the flow direction, and the plurality of branch channels that diverge from the helical channel are each connected to the second channel at different locations in the flow direction, the fluid mixer further comprising:

a body that comprises, inside of the body, the second channel, the communicating channel and the branch channels, and that comprises, on the outer peripheral surface of the body, a helical groove communicating with the branch channels and extending from an end surface on the side of the communicating channel, and a housing that comprises the first channel at one end of the housing and an inner peripheral surface that forms the helical channel with the helical groove when the housing fits over the outer peripheral surface of the body, wherein the first channel, the second channel and the communicating channel are coaxially disposed with each other, wherein a plurality of the helical grooves are disposed on the outer peripheral surface of the body, wherein the helical grooves are circumferentially offset with respect to each other, and wherein at least one of the plurality of helical grooves has a length that is shorter than the length of the other helical groove(s), and a terminal end of the shorter helical groove joins the other helical groove(s).

7. The fluid mixer according to claim 6, wherein the helical groove is progressively wider from the fluid inlet side toward the fluid outlet side.

8. The fluid mixer according to claim 6, wherein the helical groove is progressively wider from the fluid inlet side toward the fluid outlet side.

9. The fluid mixer according to claim 6, wherein the second channel has a cross-sectional area that progressively increases from the fluid inlet side toward the fluid outlet side, and wherein the cross-sectional area of the second channel at respective connections between the plurality of the branch channels and the second channel is equal to or smaller than the sum of the cross-sectional areas of the branch channels at the connections in which fluid has flowed into the second channel before reaching the respective connections and the cross-sectional area of the communicating channel.

10. The fluid mixer according to claim 7, wherein the second channel has a cross-sectional area that progressively increases from the fluid inlet side toward the fluid outlet side, and wherein the cross-sectional area of the second channel at respective connections between the plurality of the branch channels and the second channel is equal to or smaller than the sum of the cross-sectional areas of the branch channels at the connections in which fluid has flowed into the second channel before reaching the respective connections and the cross-sectional area of the communicating channel.

11. The fluid mixer according to claim 8, wherein the second channel has a cross-sectional area that progressively increases from the fluid inlet side toward the fluid outlet side, and wherein the cross-sectional area of the second channel at respective connections between the plurality of the branch channels and the second channel is equal to or smaller than the sum of the cross-sectional areas of the branch channels at the connections in which fluid has flowed into the second channel before reaching the respective connections and the cross-sectional area of the communicating channel.

12. A system using a fluid mixer, the system comprising:

the fluid mixer according to claim 6, and flow channel forming means for forming flow channels that combine and direct a plurality of different fluids.

* * * * *